US010894661B2

(12) United States Patent
Pherson et al.

(10) Patent No.: US 10,894,661 B2
(45) Date of Patent: Jan. 19, 2021

(54) FABRIC AIR CARGO CONTAINER DOORS HAVING IMPROVED FASTENING SYSTEM

(71) Applicant: Advanced Composite Structures, LLC, Charleston, SC (US)

(72) Inventors: Thomas R. Pherson, Daniel Island, SC (US); Michael Carter, Charleston, SC (US)

(73) Assignee: Advanced Composite Structures, LLC, Charleston, SC (US)

( * ) Notice: Subject to any disclaimer, the term of this patent is extended or adjusted under 35 U.S.C. 154(b) by 270 days.

(21) Appl. No.: 15/939,792

(22) Filed: Mar. 29, 2018

(65) Prior Publication Data

US 2019/0300276 A1 Oct. 3, 2019

(51) Int. Cl.
*B65D 90/02* (2019.01)
*B65D 88/14* (2006.01)

(52) U.S. Cl.
CPC ..... *B65D 90/021* (2013.01); *B65D 88/14* (2013.01)

(58) Field of Classification Search
CPC ..... B65D 90/021; B65D 90/08; B65D 88/14; B65D 88/129; B65D 88/24; A44B 18/0038; E06B 3/80
See application file for complete search history.

(56) References Cited

U.S. PATENT DOCUMENTS 4,991,640 A * 2/1991 Verkindt ..... B60P 7/04 160/368.1
6,755,232 B1 6/2004 Holland et al.
7,311,216 B2 12/2007 Donnelly et al.
7,622,406 B2 11/2009 Holland et al.
7,820,570 B2 10/2010 Holland et al.
7,828,029 B2 11/2010 Holland et al.
8,479,801 B2 7/2013 Holland et al.
9,174,796 B2 11/2015 Pherson et al.
9,174,797 B2 11/2015 Pherson et al.
9,248,958 B2 2/2016 Pherson
9,834,374 B2 12/2017 Pherson
2012/0118881 A1* 5/2012 Holland ..... B65D 90/021 220/1.5
2016/0046441 A1 2/2016 Holland et al.
2017/0096295 A1 4/2017 Pherson et al.

FOREIGN PATENT DOCUMENTS

WO 2013106640 7/2013

OTHER PUBLICATIONS

Search Report for EP19165735.2, dated Jun. 3, 2019, 6 pgs.

* cited by examiner

*Primary Examiner* — Andrew T Kirsch

(74) *Attorney, Agent, or Firm* — Womble Bond Dickinson (US) LLP

(57) ABSTRACT

A fabric closure for the open end of an air cargo container having a fabric door and a fastening system for connecting the opposed side edges of the fabric door to couplings attached to the container. The fastening system includes at least one fabric pocket, a protective strip attached to the outer surface of the pocket, and a connecting strap for being secured around a respective coupling. The connecting strap passes through the fabric pocket and is engaged with a hook and loop fastener portion on the protective strip.

21 Claims, 9 Drawing Sheets

FABRIC AIR CARGO CONTAINER DOORS HAVING IMPROVED FASTENING SYSTEM

TECHNICAL FIELD

This application relates to air cargo containers having fabric doors, and a fastening system for attaching the fabric doors to the containers that is configured to be readily maintained.

BACKGROUND

Cargo containers are used in a variety of transportation fields all over the world. One type of commonly used cargo container is shaped to be loaded into the cargo hold of an airplane. These are often referred to as uniform load devices (ULDs). Typically, these containers will have a top, a bottom, and a plurality of side walls. These walls may be contoured to fit efficiently within the curved body of an airplane. These containers have at least one end that is open or openable in order to facilitate the on-loading and off-loading of cargo. It is, however, important to close off this openable end of the container to retain cargo and prevent unauthorized access into the container. Through the years, the open end of cargo containers have been closed off in a number of different ways. Initially, rigid doors were used. These rigid doors were often constructed from the same metal material as the remainder of the container. These metal doors provided high strength for keeping the cargo inside, but added significant weight to the cargo container.

In any mode of shipping, but especially when shipping cargo through the air, weight is an important consideration. In order to provide closures that weighed less, fabric doors have been designed. These fabric doors have been secured to the containers in a number of ways. In one example, as shown in FIG. 1, a plurality of belting straps 10 are permanently sewn across the full width of a fabric door 12. The fabric door 12 is configured to close off an open end of an air cargo container 14. An air cargo container 14 typically includes a top 16, a bottom 18, and side walls 20 that create an interior and define the open end of the container 14. The belting straps 10 are configured to tension the fabric door 12 in the lateral direction across the width of the open end of the container 14.

The tips 30 of the belting straps 10 extend beyond the edges of the fabric door 12, and are configured to be inserted through respective couplings 34, which are typically attached to the side walls 20. The tips 30 of the belting straps 10 can then be doubled back for closure with hook and loop or other releasable fastener. Because the belting straps 10 are permanently sewn to the fabric door 12, significant downtime occurs when the belting straps 10, or hook and loop fastener portions thereof, need to be replaced, such as when the hook and loop fasteners become worn after many use cycles.

More recently, another system of fastening fabric doors 12 to air cargo containers 14 was developed that included permanently sewn patches on the exterior of the fabric door to create a plurality of pockets 50 as shown in FIG. 2. Each pocket 50 was configured to removably mate with a web fastener 54 used to attach the fabric door 12 to each of the couplings 34. Each pocket 50 is typically provided with hook and loop fastener material to enhance the mated connection with the web fastener 54. The hook and loop fastener material on the pocket 50, however, is susceptible to wear much like the hook and loop fastener material on the belting straps 10 (FIG. 1), again resulting in significant downtime for repairs due to the required replacement of substantially permanently affixed elements. An example of a pocket used with a web fastener is further described in WO 2013/106640, which is incorporated herein in its entirety.

Therefore, there is a desire to extend the useful life of a fabric door of an air cargo container prior to performing anticipated maintenance that requires replacement of a portion of the fabric door that is substantially permanently affixed thereto.

BRIEF SUMMARY

One embodiment of the present disclosure includes a fabric closure for the open end of an air cargo container of the type having a plurality of side walls, a bottom, a top, and at least one open end, each of the side walls adjacent to the open end contain a plurality of couplings affixed thereto. The fabric closure comprises a fabric door having top and bottom edges and opposed side edges, and a fastening system for at least connecting the opposed side edges of the fabric door to the couplings. The fastening system comprises at least one fabric pocket affixed to an exterior surface of the fabric door, at least an outer surface of the pocket having a first hook and loop fastener portion. The fastening system also includes a protective strip attached to the outer surface of the pocket, wherein the protective strip includes opposed first and second sides, the first side having a second hook and loop fastener portion, and the second side having a third hook and loop fastener portion, wherein the first hook and loop fastener portion is engaged with the second hook and loop fastener portion. The fastening system also includes a connecting strap for being secured around a respective one of the plurality of couplings, wherein the connecting strap passes through the fabric pocket and is engaged with the third hook and loop fastener portion on the second side of the protective strip.

In another implementation of the embodiments of the present disclosure, a cargo container is described that may include a plurality of side walls, a bottom, a top, and at least one open end, each of the side walls that is adjacent to the open end has a plurality of couplings affixed thereto. The container may also include a fabric closure removably attached to the cargo container to close the open end. The fabric closure comprises a fabric door having top and bottom edges and opposed side edges, and a fastening system for at least connecting the opposed side edges to the couplings. The fastening system comprises a fabric pocket affixed to an exterior surface of the fabric door, at least an outer surface of the pocket having a first hook and loop fastener portion. The fastening system also includes a protective strip attached to the outer surface of the pocket, wherein the protective strip includes opposed first and second sides, the first side having a second hook and loop fastener portion, and the second side having a third hook and loop fastener portion, wherein the first hook and loop fastener portion is engaged with the second hook and loop fastener portion. The fastening system also includes a connecting strap for being secured around a respective one of the plurality of couplings, wherein the connecting strap passes through the fabric pocket and is engaged with the third hook and loop fastener portion on the second side of the protective strip.

Some embodiments of the fastening system of the fabric closure and of the air cargo container as described herein provide for a method of maintaining a fabric closure for the open end of an air cargo container. The method comprises replacing a strap of the fastening system after a first number of use cycles of the fabric closure, and replacing a protective strip of the fastening system after a second number of use cycles of the fabric closure, wherein the second number of use cycles is at least ten times the first number of use cycles.

These and other aspects of the present invention will become apparent to those skilled in the art after a reading of the following description of the preferred embodiments, when considered in conjunction with the drawings. For example, where damage to conventional straps for other types of cargo containers, such as those used on ships and trains, readily occurs, the closure straps described herein might provide similar advantages. It should be understood that both the foregoing general description and the following detailed description are exemplary and explanatory only and are not restrictive of the invention as claimed.

DETAILED DESCRIPTION OF THE PREFERRED EMBODIMENTS

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 3:
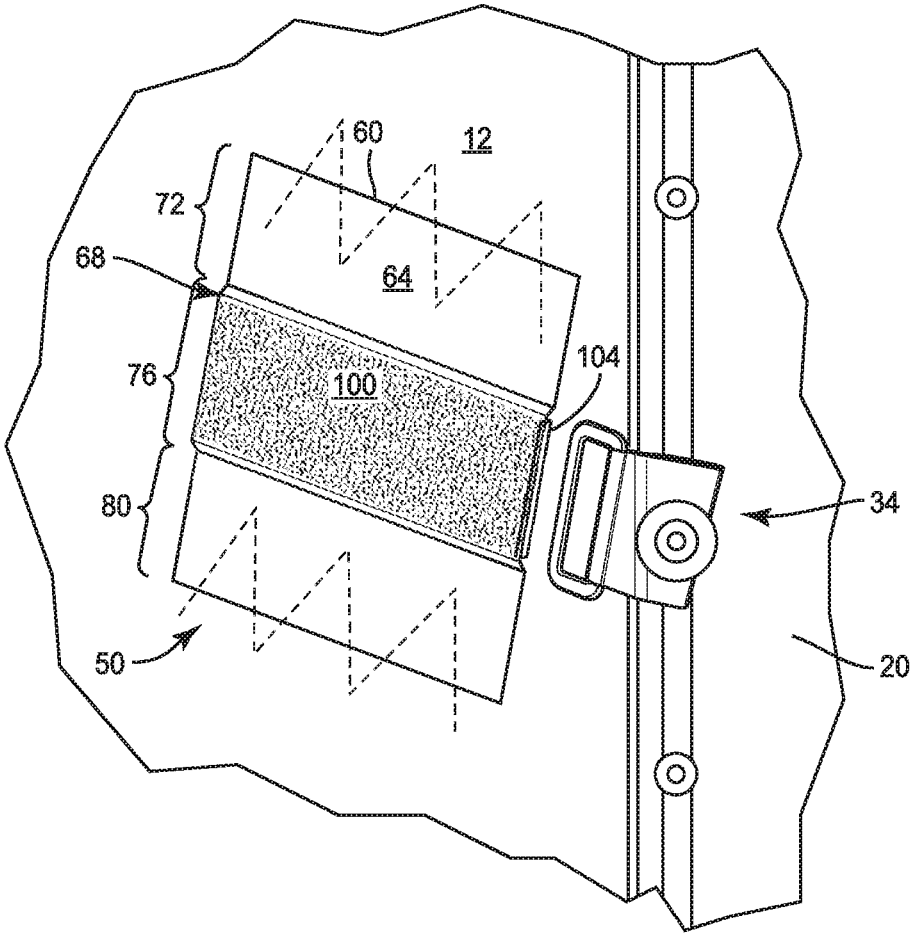
FIG. 3 shows a pocket construction suitable for use with a fastening system for fabric doors of air cargo containers according to one embodiment of the present disclosure.

Turning to FIG. 3, a pocket 50 according to one embodiment is formed on the fabric door 12. First, it is noted that the fabric door 12 may be formed from a variety of materials. The fabric door 12 may be constructed from vinyl-coated polyester. Preferably, however, the fabric door 12 will be made from high performance fabrics. As used herein the terms "high performance fabrics" and "high strength yarns" means fabrics or yarns formed from fibers having tenacities equal to or greater than about 7 g/d. Preferably, these fibers have initial tensile moduli of at least about 150 g/d and energies to break of at least about 8 J/g as measured by ASTM D2256. As used herein, the terms "initial tensile modulus," "tensile modulus," and "modulus" mean the modulus of elasticity as measured by ASTM 2256 for a yarn or by ASTM D638 for an elastomer or matrix material. These high performance fabrics include ultra-high molecular weight polyethylene and others such as aramid, liquid crystal polymers, poly(p-phenylene-2,6-benzobisoxazole) (PBO), and others. Examples of this material include materials sold under the trade name Spectra®. The fabric for the door is preferably woven, and includes at least 50% (and preferably at least 75%) of these high strength fibers. Further, the material for the fabric doors 12 is preferably waterproof, which may be obtained by laminating a film of ethylene vinyl acetate (EVA), polyethylene, or the like onto the surface. Use of a waterproof material will protect the contents of the cargo container 14 from rain water or other liquids.

The pocket 50 may be formed by a fabric patch 60, for example, formed of high strength yarns such as ultra-high molecular weight polyethylene and the like. The fabric patch 60 has an outer surface 64 and an inner surface 68. The patch 60 may have three sections; a top section 72, a middle section 76 and a lower section 80. The top section 72 and the bottom section 80 are substantially permanently affixed to the fabric door 12. In an embodiment, the top section 72 and bottom section 80 are sewn onto the fabric door 12 with high strength yarn. In an embodiment, the stitching that attaches the top section 72 and bottom section 80 of the patch 60 to the fabric door 12 runs the width of the patch and extends beyond the lateral edges of the patch to securely hold the edges of the patch to the fabric door 12. This overlap minimizes the risk of the edges of the patch 60 from being separated from the door 12.

The middle section 76 of the patch 60 is spaced from, and not directly attached to the exterior surface of the fabric door 12. The attachment of the top and bottom portions 72, 80 provides the ability for the middle section 76 to separate from the exterior surface of the fabric door 12. This separation forms a passage, or pocket, between the middle section 76 and the fabric door 12 from one side of the patch 60 to the other for passage of straps, e.g., a web strap 54.

The middle section 76 of the patch 60 may include a hook and loop fastener portion 100 on the outer surface 64 of the patch, and another hook and loop fastener portion 104 on the inner surface 68 of the patch. As is well known, hook and loop fasteners are formed by the joining of two mating materials. For example one mating material may comprise hooks and the other mating material may comprise loops. As used in this disclosure, a hook and loop fastener "piece" or "portion" refers to one of the first and second mating materials, either a hook material or a loop material. In the case where two adjacent hook and loop fastener portions are intended to be engageable, the selection of the type of mating materials may be determined such that when in use, each piece mates with an opposite type material. In some embodiments, however, two surfaces with hooks may provide suitable fastening to one another. Hook and loop fasteners suitable of use herein may include traditional hook-shaped elements as found in commercially available products such as Velcro® brand sew on tape. These conventional hook and loop fasteners are configured for minimum shear strength of about 14 lb./in$^2$ and minimum peel strength of about 0.4 lb./inch of width, and are expected to have a useful life of about 1000-5000 use cycles, i.e., open and closing cycles, depending on material. In some instances, high strength hook and loop fastener portions may be used whose hooks are commonly referred to as mushroom shaped. Mushroom shaped hook materials are commercially available in products such as Velcro® 87S or Paiho C1001MH. These mushroom shaped hooks are configured for minimum shear strength exceeding about 36 lbs./in$^2$, but are expected to have a useful life of less than about 25 use cycles. In the illustrated embodiment of FIG. 3, both hook and loop fastener portions 100, 104 on opposite sides of the pocket 50 may both comprise loop material.

Figure 4:
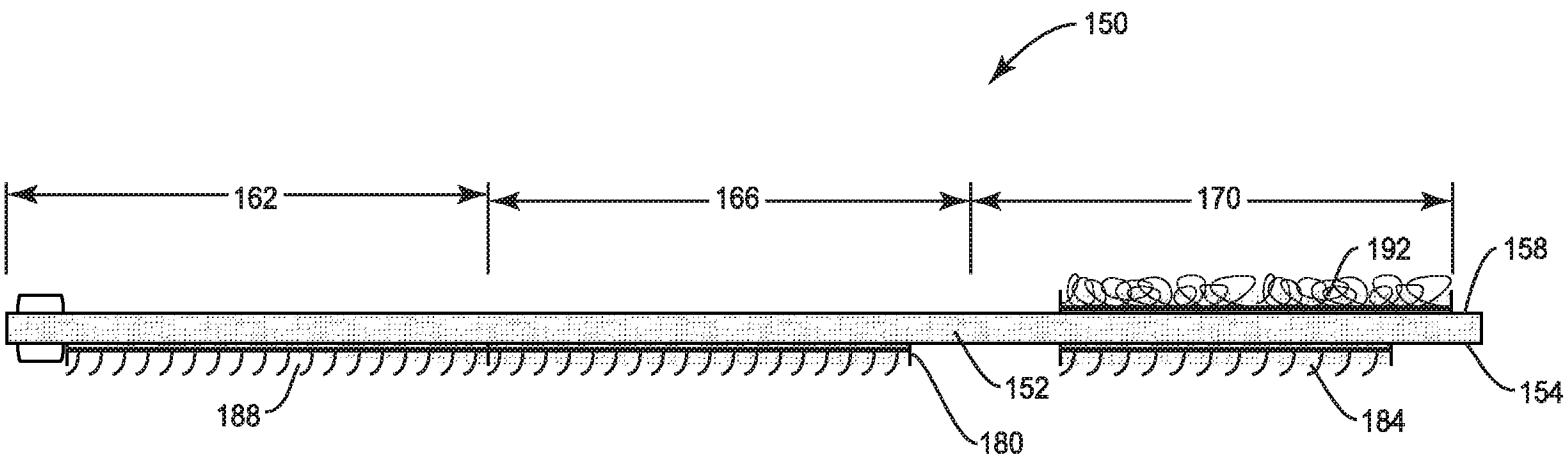
FIG. 4 shows a strap construction suitable for use with a fastening system for fabric doors of air cargo containers according to one embodiment of the present disclosure.

Turning to FIG. 4, a strap 150 suitable for use with the fastening system of the present disclosure is illustrated according to one embodiment. The strap 150 is intended to pass through the pocket 50 (FIG. 3) and connect the fabric door 12 to a respective coupling 34. The strap 150 may include a web 152, such as a fabric web constructed from high tenacity fibers, which may include a first surface 154 and a second surface 158. The strap 150 may further include an inward segment 162, a middle segment 166 and an outward segment 170. The inward and outward segments 162, 170 are defined relative to the fabric door 12 (FIG. 3) when the strap 150 is passed through the pocket 50. Each segment 162, 166, 170 of the strap 150 can be slightly longer than the length of the patch 60 (FIG. 3). The first surface 154 of the strap 150 may be intended to face away from the fabric door 12 when the strap is passed through the pocket 50. The first surface 154 may include three separate hook and loop fastener portions, a middle portion 180 suitable for mating with the hook and loop fastener portion 104 on the inner surface 68 of the pocket 50, an outward portion 184 suitable for mating with the hook and loop fastener portion 100 on the outer surface 64 of the pocket, and an inward portion 188 suitable for mating with an additional hook and loop fastener portion 192 applied to the second side 158 of the strap 150 along the outward segment 170 thereof. In the illustrated example, each of the middle portion 180, outward portion 184, and inward portion 188 of hook and loop fastener may each comprise hook materials, preferably conventional hook materials that are designed to endure a high number of use cycles and allow for being readily unfastened. In the illustrated example, the additional hook and loop fastener portion 192 applied to the second side 158 of the strap 150 may comprise a loop material. In one embodiment, the middle portion 180 can be made from a contrasting color to the other materials on the first surface 154, for example brightly colored yellow or orange. The brightly colored contrast may provide an indication of when the strap 150 is properly positioned within the pocket 50 by hiding the brightly colored portion. In one embodiment, the hook and loop fastener portion 104 within the pocket 50 is created with a corresponding bright colored material as an indicator of portions of the pocket and the strap 150 which are intended to attach to one another.

Figure 5:
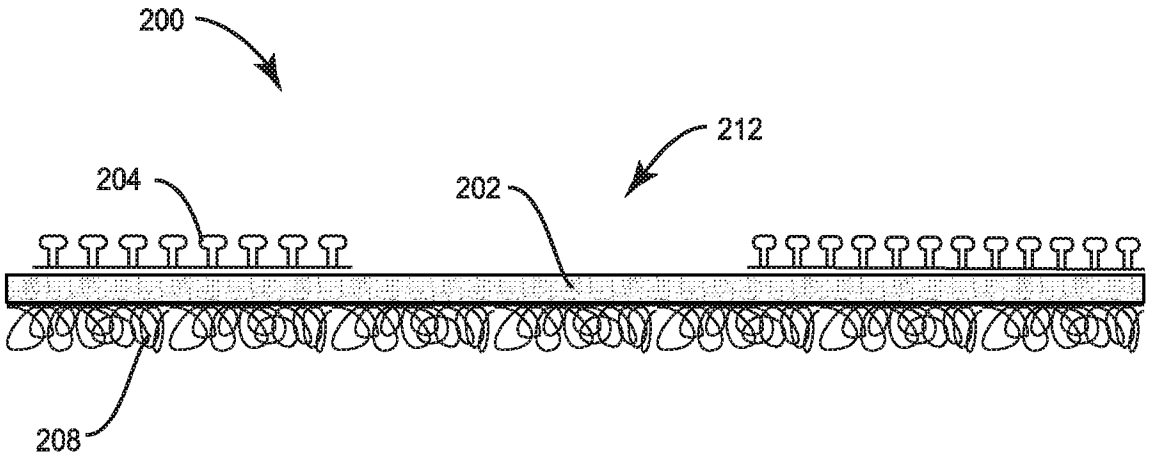
FIG. 5 shows a protective strip suitable for use with a fastening system for fabric doors of air cargo containers according to one embodiment of the present disclosure.

Turning to FIG. 5, a protective strip 200 is illustrated. The protective strip 200 may include a substrate layer 202, such as a fabric web constructed from high tenacity fibers. A first side of the protective strip 200 comprises a hook material 204. In one embodiment, the hook material 204 is the type with mushroom-shaped hooks. The hook material 204 is configured to attach to the hook and loop fastener portion 100 on the outer surface 64 of the pocket 50. The opposite, second side of the protective strip 200 comprises a hook and loop fastener portion, such as a loop material 208.

In one embodiment, the longitudinal length of the protective strip 200 is greater than the longitudinal length of the pocket 50 but less than about twice the longitudinal length of the pocket. With the relative dimensions prescribed, as possibly best seen in FIG. 7, the protective strip 200 can be attached via the hook material 204 to the outer surface of the pocket 50. The excess length of the protective strip 200 can then provide two wings that can be tucked into the pocket 50 and may be engaged with the hook and loop fastener portion 104 attached to the inner surface 68 of the pocket. By extending the protective strip 200 around the edges and into the interior of the pocket 50, the protective strip may be less susceptible to unintentionally peeling away from the pocket.

In the illustrated embodiment of FIG. 5, the hook material 204 includes a gap 212. The gap 212 is configured to create a region without exposed hooks or loops to facilitate selective separation of the protective strip 200 from the pocket 50. The gap 212 may be particularly useful when the hook material 204 comprises mushroom-shaped hooks because the strength of the attachment provided by the mushroom-shaped hooks may be difficult to break by hand if the entire area of the protective strip is engaged with corresponding hook and loop fastener portions.

Figure 6:
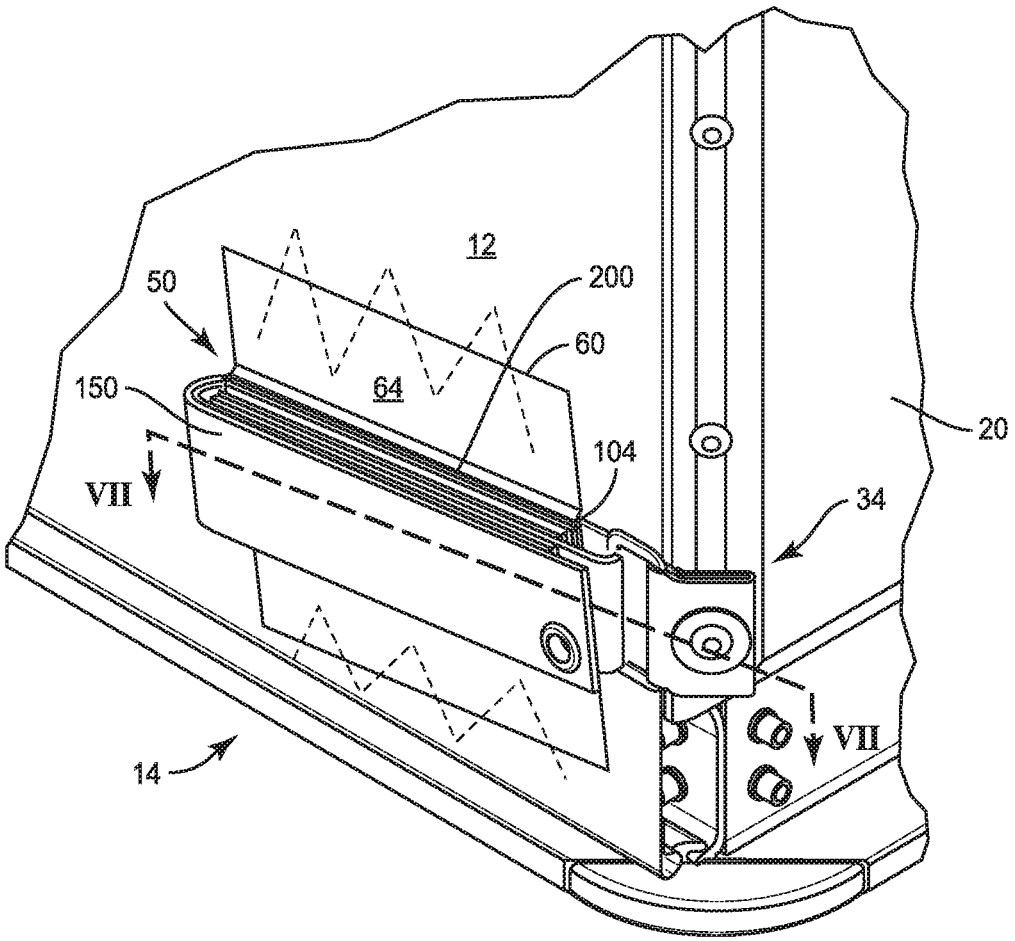
FIG. 6 shows one embodiment of the fastening system according to the present disclosure securing a fabric door to an air cargo container.
Figure 7:
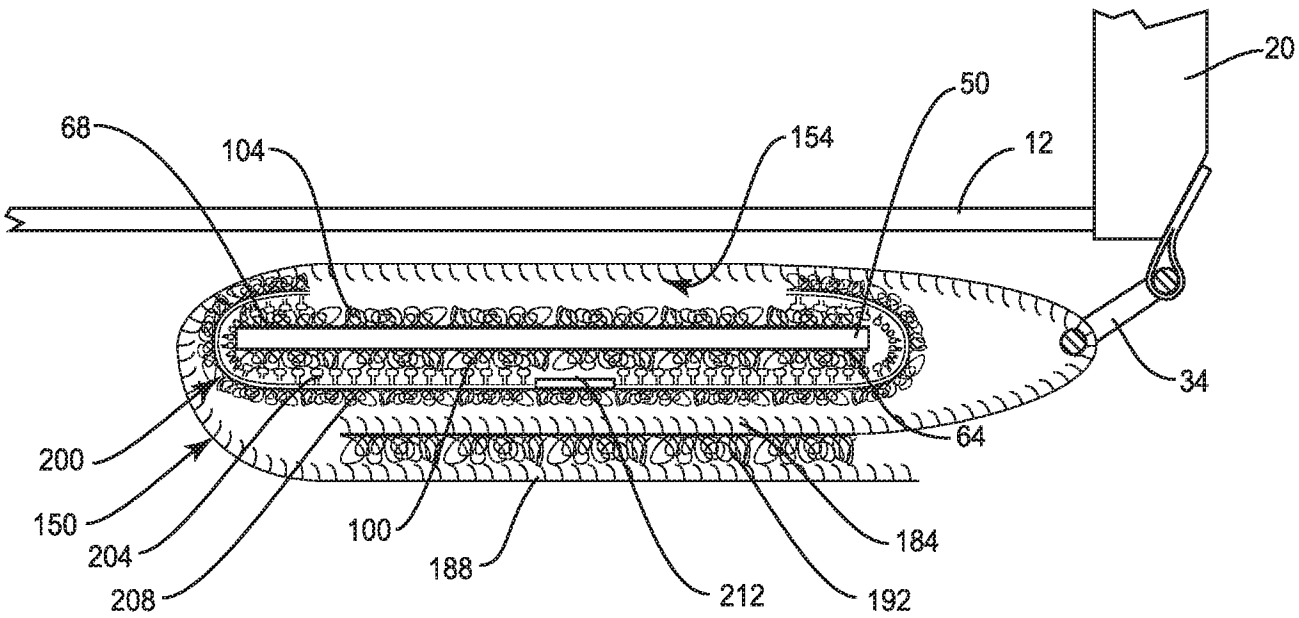
FIG. 7 shows a cross section of the fastening system applied to the fabric door as shown in FIG. 6.

As shown in FIGS. 6 and 7, the protective strip 200 is configured to attach to the pocket 50. The protective strip 200 interfaces between the pocket 50 and the strap 150 to protect the hook and loop fastener portion 100 on the outer surface 64 of the pocket. As a result, the maintenance cycle time of the fabric door 12 can be extended between repairs that require removal and replacement of elements that are permanently attached to the fabric door. For example, with customary use, as the strap 150 is fastened and unfastened for the fabric door 12 to be opened and closed relative to the container 14, the loop material 208 on the protective strip 200 may eventually wear and require replacement. With existing pocket arrangements, the worn hook and loop fastener portion would have been sewn to the outer surface of the pocket. With the present embodiment, which incorporates the protective strip 200, the worn hook and loop fastener portion is part of the protective strip, which can be readily removed from the pocket 50 and replaced with a new protective strip.

FIG. 6 illustrates the fabric door 12 coupled to the container 14 using a pocket 50, strap 150, and protective strip 200 according to the embodiments of each discussed above. FIG. 7 illustrates a schematic longitudinal cross section of FIG. 6. As discussed above, the protective strip 200 can be applied to the pocket 50 by mating the hook material 204 to the hook and loop fastener portion 100 on the outer surface 64 of the pocket. The protective strip 200 can be approximately centered relative to the pocket 50. The ends of the protective strip 200 can then be folded under and inserted into the pocket 50 so that the hook material 204 engages with the hook and loop fastener portion 104 on the inner surface 68 of the pocket.

In order to connect the fabric door 12 to the coupling 34, the strap 150 is inserted and passed through the pocket 50 with the first surface 154 facing outward way from the fabric door until the middle segment 166 (FIG. 4) is hidden by the patch 60 (FIG. 3). The hook and loop fastener portion 180 on the middle segment 166 of the strap 150 can mate with one or both of a portion of the loop material 208 of the protective strip 200 and the hook and loop fastener portion 104 on the inner surface 68 of the pocket 50 in order to retain the strap within the pocket.

With the strap 150 properly positioned within the pocket 50, the outward segment 170 of the strap can be passed through the coupling 34 and folded back toward the inward segment 162 such that the hook and loop fastener portion 184 engages with the loop material 208 of the protective strip 200. The inward segment 162 can then be folded in an outward direction such that the hook and loop fastener portion 188 thereon mates with the hook and loop fastener portion 192 on the second side 158 of the strap.

As discussed above, use of the protective strip 200 extends the number of use cycles of the fabric door 12 between anticipated maintenance events that require removal and replacement of a portion or portions of the fabric door that are substantially permanently affixed thereto. Thus, the use of the protective strip 200 can facilitate a method of maintaining the fabric door 12 that includes replacing the strap 150 after a first number of use cycles of the fabric door, and replacing the protective strip 200 after a second number of use cycles of the fabric door, the second number of use cycles being at least ten times the first number of use cycles.

The step of replacing the strap 150 may include removing a first strap from within the pocket 50 and inserting a second strap through the pocket. The step of replacing the protective strip 200 may include removing the strap 150 from within the pocket 50, disengaging hook material 204 from the hook and loop fastener portion 100 on the outer surface 64 of the pocket to remove the protective strip from the pocket, and attaching a new protective strip to the hook and loop fastener portion 100. The step of disengaging the hook material 204 from the hook and loop fastener portion 100 may include inserting a finger or a tool into the gap 212 formed in the hook material.

Figure 8:
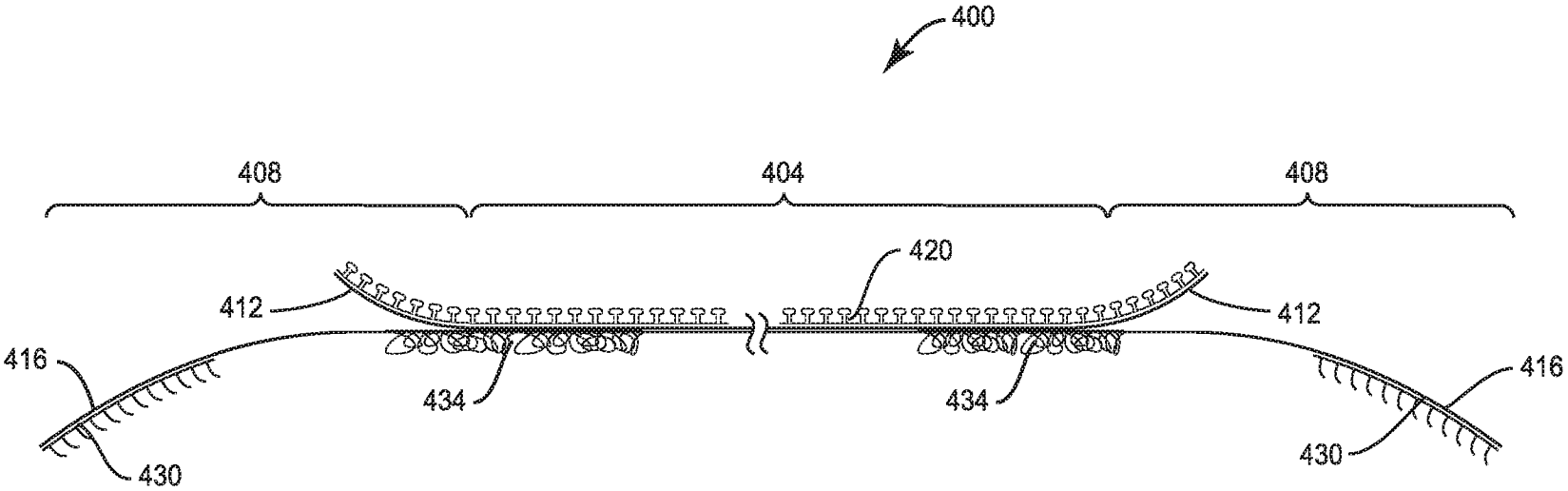
FIG. 8 shows a strap construction suitable for use with a fastening system for fabric doors of air cargo containers according to a second embodiment of the present disclosure.

Turning to FIG. 8, a closure strap 400 according to another embodiment of a fastener system for a fabric door 12 (FIG. 1) is illustrated. The closure strap 400 may be suitable for use with fabric doors 12 that do not include pockets, such as the one shown in FIG. 1. As understood from FIG. 1, a plurality of closure straps 400 as expected to be used on each fabric door 12.

Figure 9:
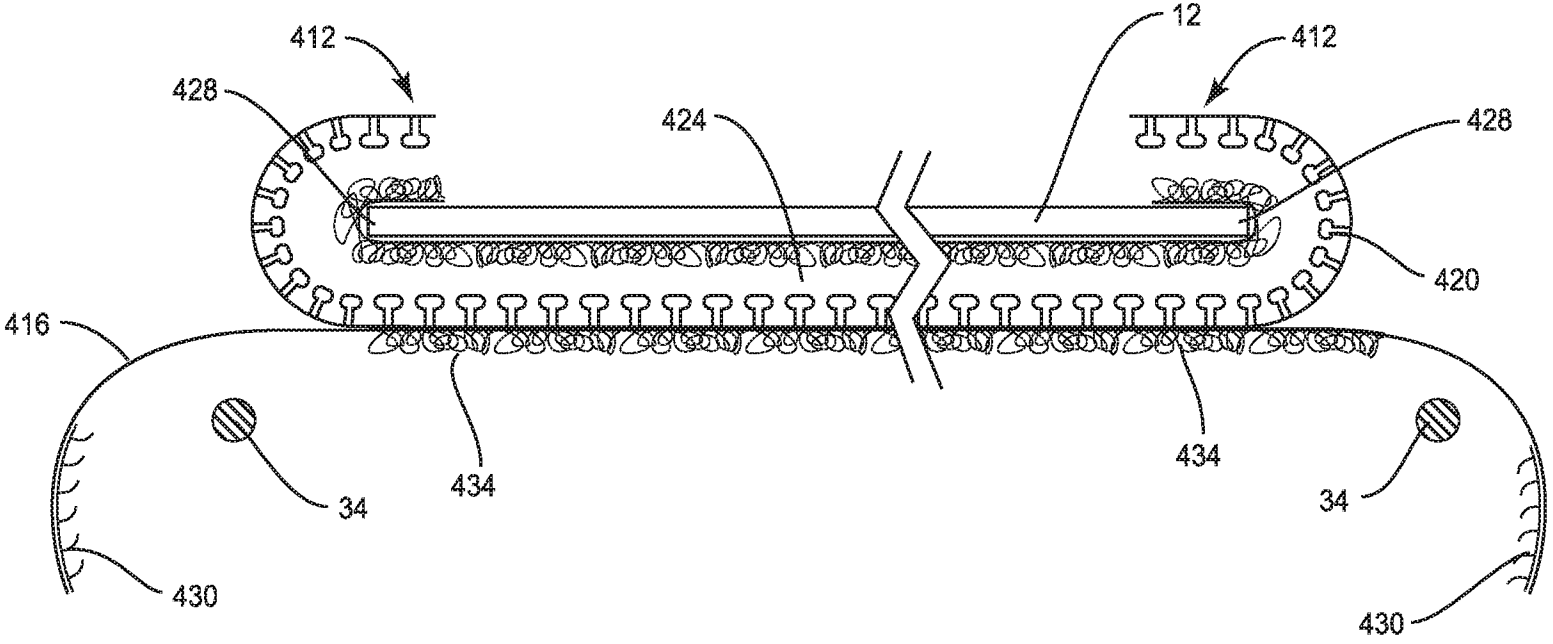
FIG. 9 shows a cross section of the fastening system according to the second embodiment in-use securing a fabric door to an air cargo container.

The closure strap 400 may include a central region 404 and a pair of end regions 408. Each end region 408 can include an attachment tab 412 and a connection segment 416. On the side of the closure strap 400 with the attachment tabs 412, at least one hook and loop fastener portion 420 can be provided for the purpose of removably attaching the closure strap 400 to the fabric door 12. As shown in FIG. 9, the fabric door 12 according to the present embodiment includes at least one hook and loop fastener mating strip 424. The hook and loop fastener mating strip 424 may extend the full width of the fabric door 12 and extend around the side edges 428 or otherwise provide a region of hook and loop fastener along the interior surface of the fabric door. Each attachment tab 412 of the closure strap 400 may be configured to wrap around a respective side edge 424 of the fabric door 12 to attach to the region of the hook and loop fastener mating strip 424 located along the interior surface of the fabric door. In one embodiment, the mating strip is a contrasting color from the fabric door 12, preferably a bright color such as yellow or orange. In this embodiment, the bright color would be visible if the closure strap 400 is not properly aligned with the mating strip 424.

As shown in FIG. 8, each connection segment 416 may include a hook and loop fastener portion 430, and a corresponding hook and loop fastener portion 434 may be provided along the central region 404 adjacent to the connection segment 416 on the side of the closure strap 400 with the connection segments. Thus, as shown in FIG. 9, the connection segment 416 can pass through a respective coupling 34 and attach back to the closure strap 400 by engaging the two hook and loop fastener portions 430, 434. The corresponding hook and loop fastener portion 434 may be provided as a brightly colored material to help indicate proper alignment when the hook and loop fastener portion 430 is coupled thereto.

Figure 1:
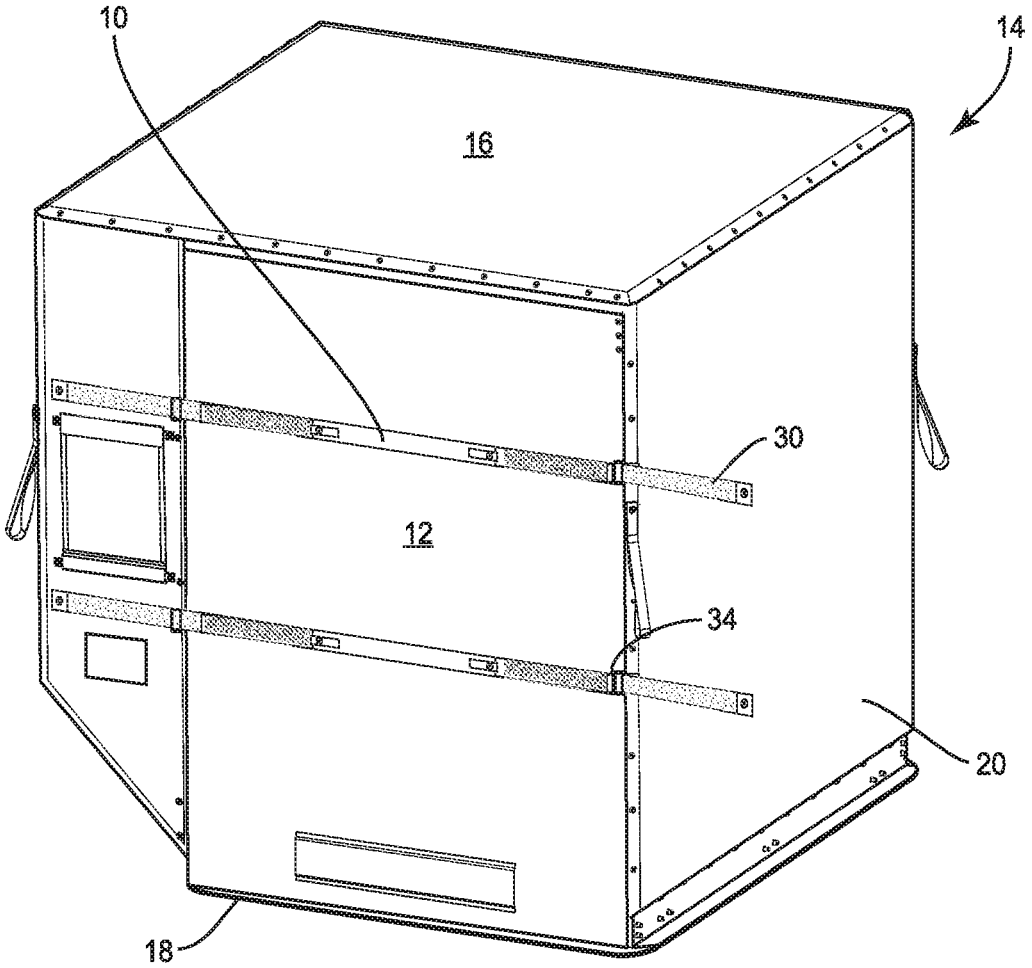
FIG. 1 (PRIOR ART)
FIG. 1 shows an air cargo container with a fabric door employing a first prior art fastening system.
Figure 2:
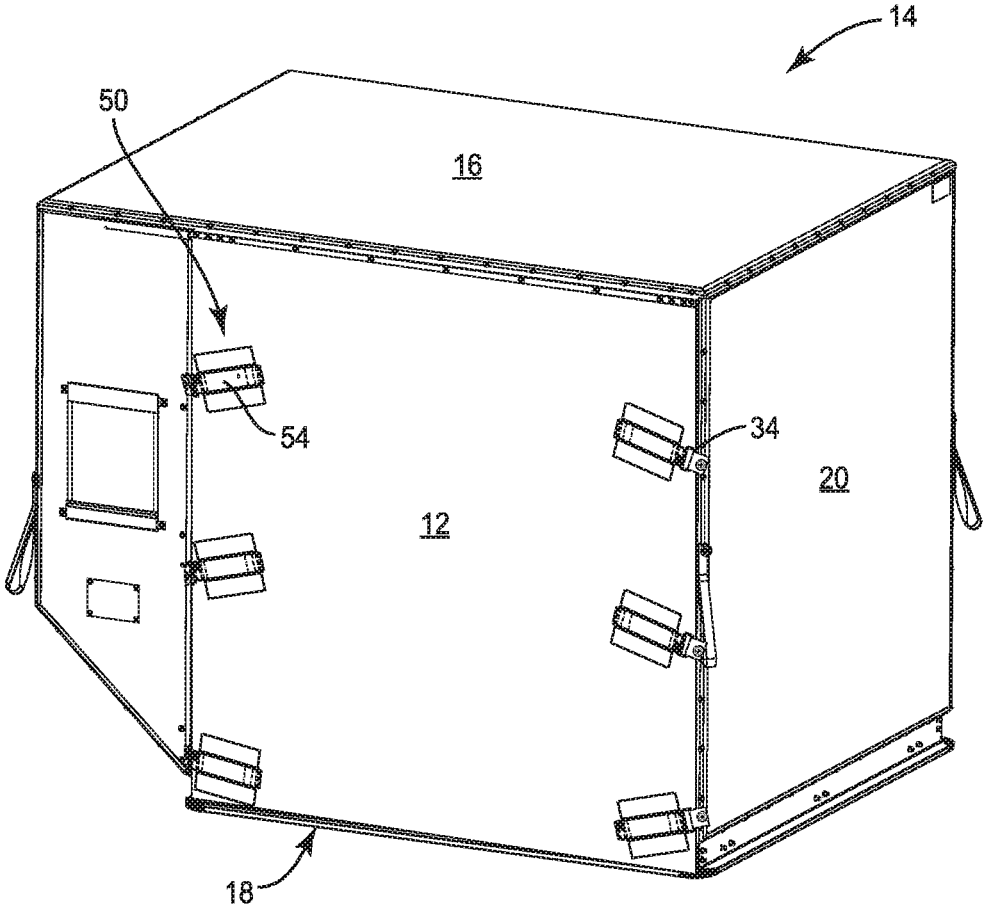
FIG. 2 (PRIOR ART)
FIG. 2 shows an air cargo container with fabric door employing a second prior art fastening system.

The second embodiment, illustrated in FIGS. 8 and 9, again provides an improvement over the sewn-on belting straps 10 of FIG. 1 because the closure straps 400 can be much more easily disconnected from the fabric door 12 and replaced that the belting straps 10. A fabric door 12 employing the closure straps 400 can be described in terms of the following paragraphs.

Paragraph 1: A fabric door for the open end of cargo containers of the type having a plurality of side walls, a bottom, a top, and at least one open end, each of the side walls surrounding the open end containing a plurality of couplings affixed thereto, the fabric door comprising:

a fabric panel having top and bottom edges and opposed side edges, a plurality of hook and loop fastener mating strips affixed to the fabric door along an exterior surface thereof to extend between the opposed side edges thereof and wraparound the opposed side edges to terminate along an interior surface of the fabric door; and a plurality of closure straps for at least connecting the opposed side edges of the fabric door to the couplings, each closure strap comprising:

a central region attached to a respective hook and loop fastener mating strip; and a pair of end regions, wherein each end region comprises:

an attachment tab configured to wrap around a respective side edge of the fabric door to attach to the portion of the hook and loop fastener mating strip located along the interior surface of the fabric door, and a connection segment configured to pass through a respective coupling and attach back to the closure strap with a hook and loop fastener portion.

Paragraph 2: The fabric door of Paragraph 1, wherein at least the central region of the closure strap comprises another hook and loop fastener portion configured to engage with the hook and loop fastener mating strip, wherein one of the hook and loop fastener mating strip and the hook and loop fastener portion comprises mushroom-shaped hooks configured for high strength fastening and less than one-hundred use cycles.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A fabric closure for the open end of an air cargo container of the type having a plurality of side walls, a bottom, a top, and at least one open end, each of the side walls adjacent to the open end contain a plurality of couplings affixed thereto, the fabric closure comprising:

a fabric door having top and bottom edges and opposed side edges; and a fastening system for at least connecting the opposed side edges of the fabric door to the couplings, the fastening system comprising:

at least one fabric pocket affixed to an exterior surface of the fabric door, at least an outer surface of the pocket having a first hook and loop fastener portion;

a protective strip attached to the outer surface of the pocket, wherein the protective strip includes opposed first and second sides, the first side having a second hook and loop fastener portion, and the second side having a third hook and loop fastener portion, wherein the first hook and loop fastener portion is engaged with the second hook and loop fastener portion; and a connecting strap for being secured around a respective one of the plurality of couplings, wherein the connecting strap passes through the fabric pocket and is engaged with the third hook and loop fastener portion on the second side of the protective strip.

2. The fabric closure according to claim 1, wherein at least one of the first and second hook and loop fastener portions includes hooks having a mushroom shape and configured for high strength fastening and less than one-hundred use cycles.

3. The fabric closure according to claim 2, wherein at least one of the first and second hook and loop fastener portions includes a region without exposed hooks or loops to facilitate selective separation of the first hook and loop fastener portion from the second hook and loop fastener portion.

4. The fabric closure according to claim 1, wherein the first and third hook and loop fastener portions both comprise loop material.

5. The fabric closure according to claim 4, wherein the second hook and loop fastener portion comprises mushroom shaped hooks.

6. The fabric closure according to claim 1, wherein the fabric pocket includes at least one fourth hook and loop fastener portion affixed to an inner surface thereof.

7. The fabric closure according to claim 6 wherein the protective strip wraps around the ends of the pocket such that the second hook and loop fastener portion engages with the at least one fourth hook and loop fastener portion within the pocket.

8. The fabric closure according to claim 6, wherein the strap is engaged with the at least one fourth hook and loop fastener portion affixed to the inner surface of the pocket.

9. The fabric closure according to claim 6, wherein the first, third, and fourth hook and loop fastener portions each comprise loop material.

10. A cargo container, comprising:

a plurality of side walls, a bottom, a top, and at least one open end, each of the side walls that is adjacent to the open end has a plurality of couplings affixed thereto; and a fabric closure removably attached to the cargo container to close the open end, the fabric closure comprising:

a fabric door having top and bottom edges and opposed side edges; and a fastening system for at least connecting the opposed side edges to the couplings, the fastening system comprising:

a fabric pocket affixed to an exterior surface of the fabric door, at least an outer surface of the pocket having a first hook and loop fastener portion;

a protective strip attached to the outer surface of the pocket, wherein the protective strip includes opposed first and second sides, the first side having a second hook and loop fastener portion, and the second side having a third hook and loop fastener portion, wherein the first hook and loop fastener portion is engaged with the second hook and loop fastener portion; and a connecting strap for being secured around a respective one of the plurality of couplings, wherein the connecting strap passes through the fabric pocket and is engaged with the third hook and loop fastener portion on the second side of the protective strip.

11. The cargo container according to claim 10, wherein at least one of the first and second hook and loop fastener portions includes hooks having a mushroom shape and configured for high strength fastening and less than one-hundred use cycles.

12. The cargo container according to claim 11, wherein at least one of the first and second hook and loop fastener portions includes a region without exposed hooks or loops to facilitate selective separation of the first hook and loop fastener portion from the second hook and loop fastener portion.

13. The cargo container according to claim 10, wherein the first and third hook and loop fastener portions both comprise loop material.

14. The cargo container according to claim 10, wherein the second hook and loop fastener portion comprises mushroom shaped hooks.

15. The cargo container according to claim 10, wherein the fabric pocket includes at least one fourth hook and loop fastener portion affixed to an inner surface thereof.

16. The cargo container according to claim 15, wherein the protective strip wraps around the ends of the pocket such that the second hook and loop fastener portion engages with the at least one fourth hook and loop fastener portion within the pocket.

17. The cargo container according to claim 15, wherein the strap is engaged with the at least one fourth hook and loop fastener portion affixed to the inner surface of the pocket.

18. The cargo container according to claim 15, wherein the first, third, and fourth hook and loop fastener portions each comprise loop material.

19. A method of maintaining a fabric closure for the open end of an air cargo container of the type having a plurality of side walls, a bottom, a top, and at least one open end, each of the side walls adjacent to the open end contain a plurality of couplings affixed thereto, the fabric closure comprising: a fabric door having top and bottom edges and opposed side edges; a fastening system for at least connecting the opposed side edges to the couplings, the fastening system comprising: a fabric pocket affixed to an exterior surface of the fabric door, at least an outer surface of the pocket having a first hook and loop fastener portion; a protective strip attached to the outer surface of the pocket, wherein the protective strip includes opposed first and second sides, the first side having a second hook and loop fastener portion, and the second side having a third hook and loop fastener portion, wherein the first hook and loop fastener portion is engaged with the second hook and loop fastener portion; and a connecting strap for being secured around a respective one of the plurality of couplings, wherein the connecting strap passes through the fabric pocket and is engaged with the third hook and loop fastener portion on the second side of the protective strip, the method comprising:

replacing the strap after a first number of use cycles of the fabric closure; and replacing the protective strip after a second number of use cycles of the fabric closure, wherein the second number of use cycles is at least ten times the first number of use cycles.

20. The method of claim 19, wherein replacing the strap comprises:

removing a first strap from within the pocket; and inserting a second strap through the pocket.

21. The method of claim 19, wherein replacing the protective strip comprises:

removing the strap from within the pocket;

disengaging the second hook and loop fastener portion from the first hook and loop fastener portion to remove the protective strip from the pocket; and attaching a new protective strip to the first hook and loop fastener portion.

* * * * *